US010480538B2

(12) United States Patent
Kajaste et al.

(10) Patent No.: US 10,480,538 B2
(45) Date of Patent: Nov. 19, 2019

(54) PLUNGER PRESSURE ACCUMULATOR

(71) Applicant: AALTO UNIVERSITY FOUNDATION, Aalto, Helsinki (FI)

(72) Inventors: Jyrki Kajaste, Vihti (FI); Jyri Juhala, Espoo (FI); Kari Saari, Luoma (FI)

(73) Assignee: AALTO UNIVERSITY FOUNDATION, Helsinki (FI)

( * ) Notice: Subject to any disclaimer, the term of this patent is extended or adjusted under 35 U.S.C. 154(b) by 191 days.

(21) Appl. No.: 15/532,536

(22) PCT Filed: Nov. 26, 2015

(86) PCT No.: PCT/FI2015/050824
§ 371 (c)(1),
(2) Date: Jun. 2, 2017

(87) PCT Pub. No.: WO2016/087711
PCT Pub. Date: Jun. 9, 2016

(65) Prior Publication Data

US 2017/0268539 A1 Sep. 21, 2017

(30) Foreign Application Priority Data

Dec. 4, 2014 (FI) ..... 20146065

(51) Int. Cl.
*F15B 1/08* (2006.01)
*F15B 1/24* (2006.01)
*F15B 21/14* (2006.01)

(52) U.S. Cl.
CPC ..... *F15B 1/086* (2013.01); *F15B 1/24* (2013.01); *F15B 21/14* (2013.01);
(Continued)

(58) Field of Classification Search
CPC .... F15B 1/086; F15B 21/14; F15B 2201/205; F15B 2201/31; F15B 2201/32; F15B 2201/41
(Continued)

(56) References Cited

U.S. PATENT DOCUMENTS 2,817,361 A 12/1957 Mercier
2,856,035 A * 10/1958 Rohacs ..... F16F 9/003 139/161 F
(Continued)

FOREIGN PATENT DOCUMENTS

CN 102177349 A 9/2011
DE 33 33 597 A1 4/1985
(Continued)

OTHER PUBLICATIONS

Finnish Search Report issued by the Finnish Patent Office in relation to Finnish Application No. 20146065 dated Jun. 17, 2015 (2 pages).
(Continued)

*Primary Examiner* — Craig M Schneider
*Assistant Examiner* — David R Deal
(74) *Attorney, Agent, or Firm* — Robert P. Michal, Esq.; Carter, DeLuca & Farrell LLP

(57) ABSTRACT

A plunger pressure accumulator includes a shell; and a plunger which is adapted to move relative to the shell into an interior space of the shell. The interior space is divided into at least two subspaces, a first subspace of which is suppliable with hydraulic fluid of an external system and a second subspace which is provided with a pressurized gas. Between the plunger and the shell is arranged a slide element upon which the plunger is supported to move to a distance apart from an internal surface of the first subspace and from an internal surface of the second subspace. The plunger
(Continued)

Figure 1:
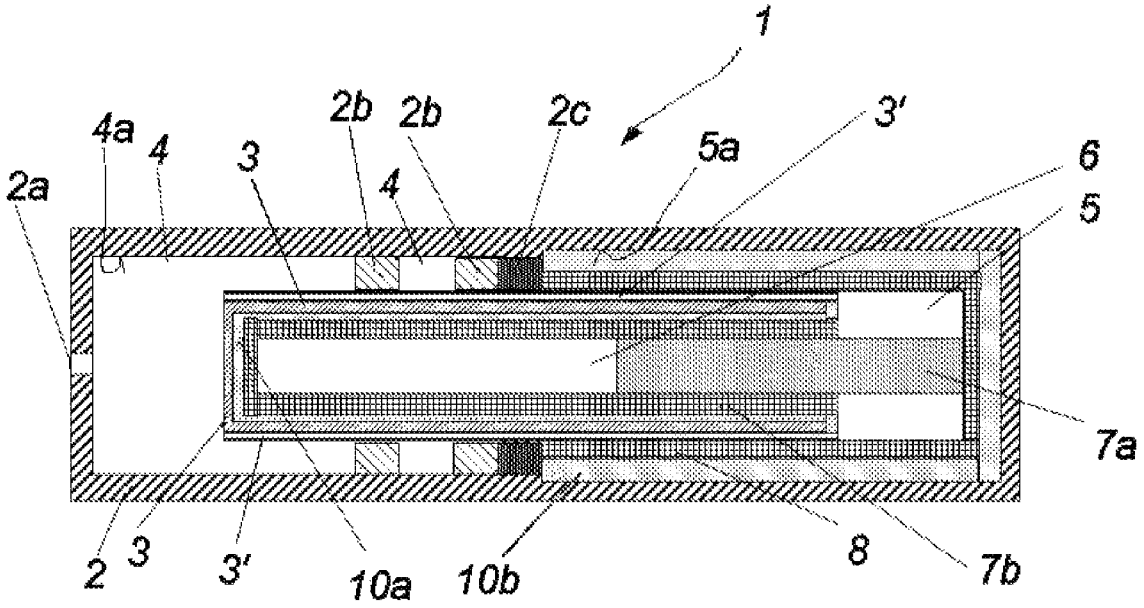

pressure accumulator is provided with at least one regenerator which is stationary relative to the shell or the plunger.

24 Claims, 4 Drawing Sheets

(52) U.S. Cl.
CPC ..... *F15B 2201/205* (2013.01); *F15B 2201/31* (2013.01); *F15B 2201/32* (2013.01); *F15B 2201/42* (2013.01)

(58) Field of Classification Search
USPC ..... 138/31
See application file for complete search history.

(56) References Cited

U.S. PATENT DOCUMENTS

| | | | | |
|---|---|---|---|---|
| 3,965,317 | A * | 6/1976 | Gratzmuller | F15B 1/033 200/82 E |
| 4,207,563 | A * | 6/1980 | Soupal | F15B 1/08 137/557 |
| 4,611,634 | A * | 9/1986 | Kruckewitt | F15B 1/24 138/31 |
| 5,664,848 | A * | 9/1997 | Muraski | B60T 8/00 138/31 |
| 6,322,160 | B1 * | 11/2001 | Loh | B60T 8/42 303/87 |
| 6,494,545 | B2 * | 12/2002 | Nakamura | B60T 8/4081 138/30 |
| 7,137,491 | B2 * | 11/2006 | Verriet | F16F 9/341 188/322.13 |
| 8,225,913 | B2 * | 7/2012 | Lee | F16F 9/53 188/267.2 |
| 2005/0194054 | A1 | 9/2005 | Moskalik et al. | |
| 2008/0314467 | A1 | 12/2008 | Gray, Jr. | |
| 2010/0206389 | A1 * | 8/2010 | Kennedy | F15B 1/24 137/14 |
| 2012/0000560 | A1 * | 1/2012 | Stroganov | F15B 1/24 138/26 |
| 2012/0297761 | A1 | 11/2012 | Strognaov | |
| 2014/0182696 | A1 * | 7/2014 | Wimmer | F15B 11/0445 137/14 |

FOREIGN PATENT DOCUMENTS

| | | | |
|---|---|---|---|
| DE | 10 2011 117 533 | A1 | 5/2013 |
| EP | 1 703 142 | A1 | 9/2006 |
| JP | 2002372008 | A | 12/2002 |
| WO | WO-2010041975 | A1 | 4/2010 |
| WO | WO-2010/134840 | A1 | 11/2010 |

OTHER PUBLICATIONS

International Search Report issued by the European Patent Office acting as the International Searching Authority in relation to International Application No. PCT/FI2015/050824 dated Apr. 7, 2016 (5 pages).

Written Opinion of the International Searching Authority issued by the European Patent Office acting as the International Searching Authority in relation to International Application No. PCT/FI2015/050824 dated Apr. 7, 2016 (5 pages).

Chinese Office Action issued by the State Intellectual Property Office of China in relation to Chinese Patent Application No. 201580073595.6 dated Apr. 16, 2018 (9 pages).

Chinese Office Action issued by the State Intellectual Property Office of China in relation to Chinese Patent Application No. 201580073595.6 dated Jun. 4, 2019 (6 pages) along with English language translation (8 pages).

* cited by examiner

PLUNGER PRESSURE ACCUMULATOR

CROSS-REFERENCE TO RELATED APPLICATIONS

This application is a National Phase Entry under 35 USC § 371 of PCT Patent Application Serial No. PCT/FI2015/050824 filed Nov. 26, 2015, which claims the benefit under 35 USC § 119(e) to Finnish Patent Application No. 20146065, filed Dec. 4, 2014, the entire disclosure of each of which is expressly incorporated herein by reference in its entirety.

The invention relates to a plunger pressure accumulator, comprising: an elongated shell; a plunger which is adapted to move in a longitudinal direction of the shell into an interior space of the shell; said space being divided into at least two subspaces, the first subspace of which is suppliable with the hydraulic fluid of an external system and the second subspace is provided with a pressurized gas.

Pressure accumulators are typically used as a part of the energy recovery system in some hydraulic system to improve the hydraulic system's overall efficiency. Hydraulic energy is stored in a pressure accumulator by using a hydraulic fluid of the hydraulic system to compress the pressure accumulator's gas present in one subspace. In a compression phase, the gas temperature rises. Available today are prior known pressure accumulators of various designs of which can be mentioned diaphragm accumulators, bladder accumulators and piston a accumulators. These are all identical in terms of basic design and operation, i.e. the shell houses two subspaces, the first subspace of which is supplied with a hydraulic fluid for compressing a gas present in the second subspace. Operation of the diaphragm and bladder accumulator is based on the deformation of a diaphragm or bladder between the spaces, allowing in the compression phase a reduction of the second subspace volume (compression of the gas). These are employed typically for the equalization of pressure fluctuations in hydraulic systems.

The piston accumulator, on the other hand, includes a piston, which is capable of sliding in contact with an internal surface of the shell in response to a force generated by a hydraulic fluid, and which also divides an interior space of the shell into two aforesaid subspaces.

In currently available pressure accumulators, the heat generated in a compression phase strives and begins to flow from pressure accumulator to environment. This constitutes a factor impairing the efficiency of a pressure accumulator. Especially in bladder and diaphragm accumulators, the elimination of this drawback is difficult because of deformations of the diaphragm or bladder. It is prior known to employ a foam type material in the gas space of bladder accumulators as presented on the internet site: http://www.hydac.com.au/www.hydac.com.au/news_technews_bladderwithfoam.aspz. In this solution, after the heat has transferred both into the gas and into the foam type material, the heat generated in the compression phase begins to migrate freely to its surroundings, i.e. into a hydraulic fluid enclosing the bladder. As for piston pressure accumulators, the publication U.S. Pat. No. 8,201,582 B2 discloses interconnected leaf elements, which are provided between the end of one of the subspaces and the piston and which open in the direction of a piston movement and which function as a compressible regenerator. In one embodiment (FIG. 3) of the publication there is presented an insulating layer provided on the internal surface of one subspace and having each leaf element fastened thereto. The piston is also provided with bellows, which operate as a vibration damper and which, due to the design and location thereof (in a direct contact with hydraulic fluid), adversely transfer heat from the gas directly to the hydraulic fluid of the first subspace and further into the environment. Such a structure, in which a complicated compressible regenerator is in contact with and in motion relative to many elements, such the shell, the piston, and the deforming insulator, is susceptible to damage. In addition, this imposes high quality requirements on the entire internal surface of a shell and on the external surface of a piston, which in turn increases manufacturing costs.

It is an objective of the present invention to provide a plunger pressure accumulator, in which the aforesaid drawbacks can be eliminated or at least substantially alleviated. An objective of the invention is to provide a plunger pressure accumulator, wherein, with a structure more cost efficient than before, it is possible to maintain the heat generated in one of the subspaces and to release it at a correct moment, for example in a discharge phase.

The aforesaid objective of the invention is attained according to the invention in such a way that between the plunger and the shell is arranged a slide element upon which the plunger is supported to move to a distance apart from an internal surface of the first subspace and from an internal surface of the second subspace, and that the plunger pressure accumulator is provided with at least one regenerator which is stationary relative to the shell or the plunger.

What is achieved with this type of plunger pressure accumulator is that a construction simpler than before enables one of the subspaces (the shell) as well as the plunger to be provided with a regenerator, for example between the movable plunger and an internal surface of the shell, as the plunger is discrete (not in contact with) from the shell. What is avoided with the plunger pressure accumulator construction according to the invention is an expensive operation of machining the internal shell surfaces into a sliding surface for the plunger, whereby finishing work is not required.

Preferred embodiments of the invention are presented in the dependent claims. These disclose additional features capable of improving the functionality and efficiency of a plunger pressure accumulator of the invention.

Figure 2:
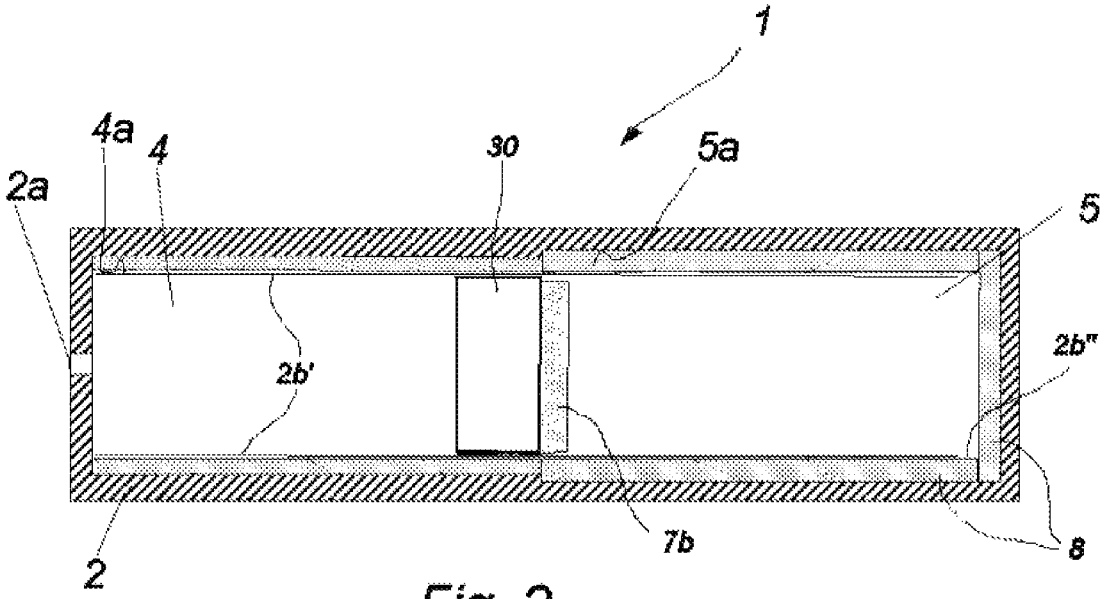
Figure 3:
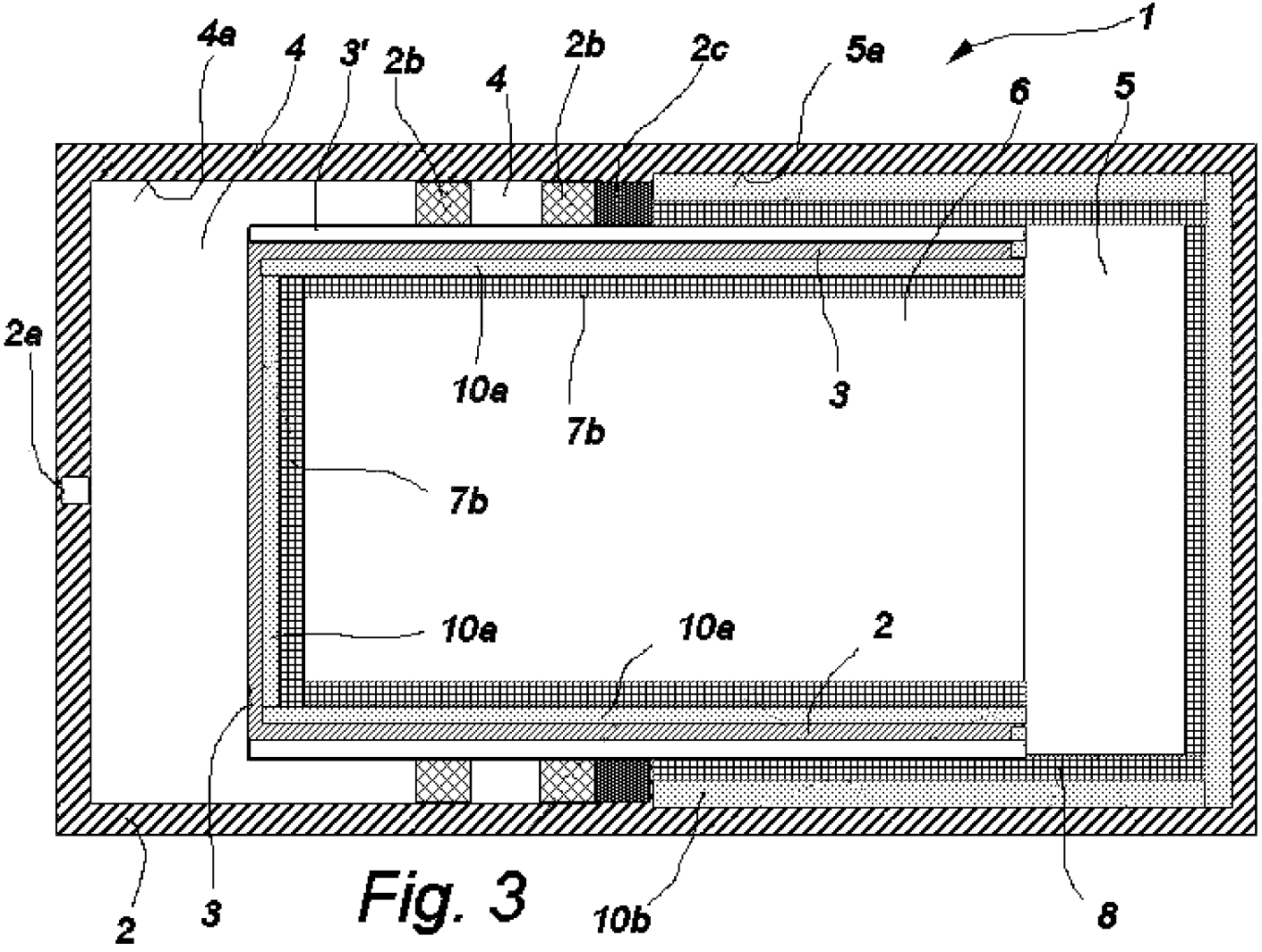
Figure 4:
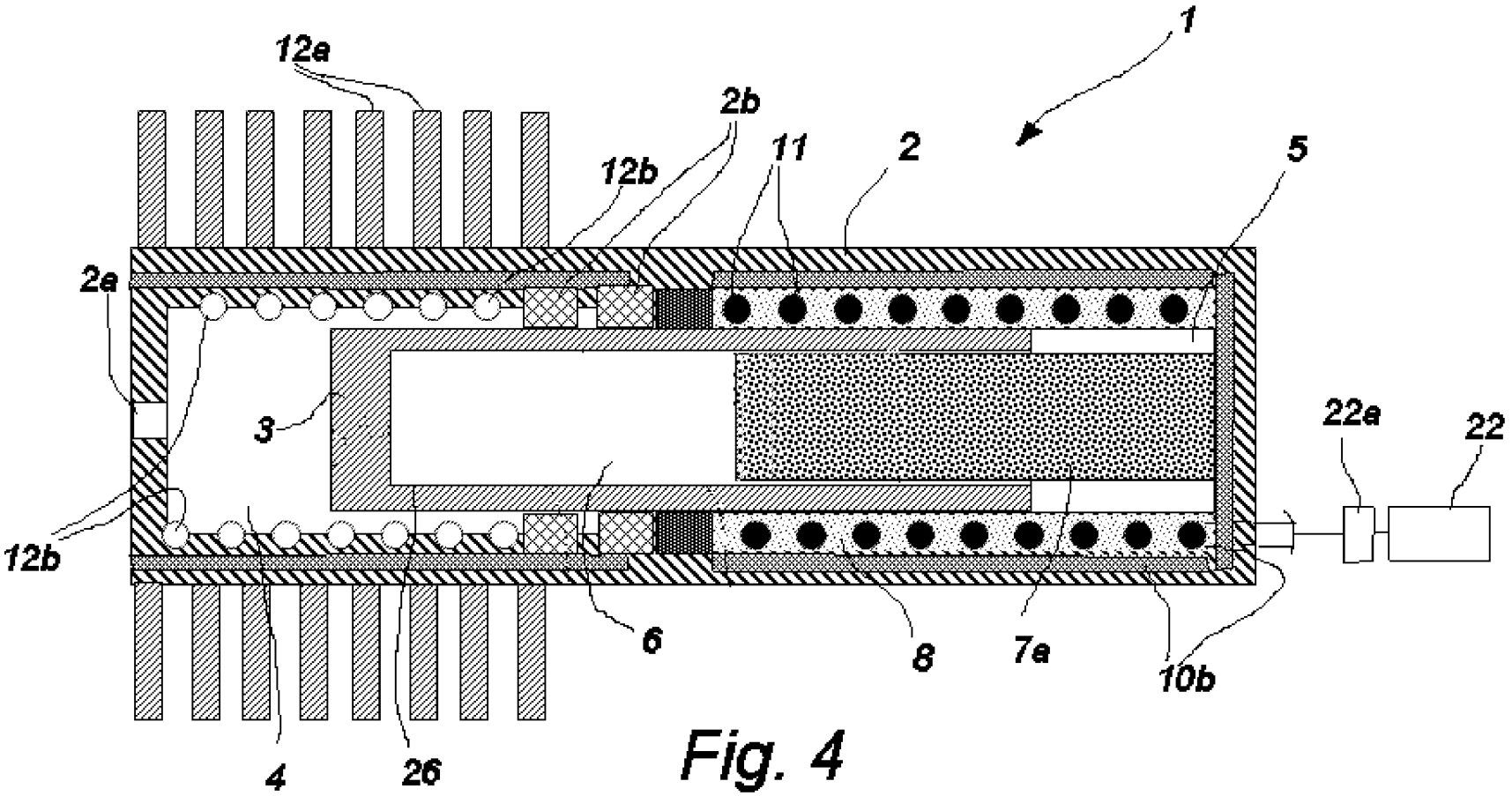

The invention will now be described more precisely with reference to the accompanying drawings, in which:

FIG. 1 shows a cross-section for a plunger pressure accumulator according to one preferred embodiment of the invention, which is provided with a ram, and FIG. 2 shows a cross-section for a plunger pressure accumulator according to a second preferred embodiment of the invention, FIG. 3 shows a cross-section for a plunger pressure accumulator according to a third preferred embodiment of the invention, which is provided with an expanded shell and plunger, and FIG. 4 shows a cross-section for a plunger pressure accumulator according to a fourth preferred embodiment of the invention, which is provided with a heat exchanger and cooling means.

Hence, in FIG. 1 there is shown a plunger pressure accumulator according to one preferred embodiment of the invention, which is denoted with reference numeral 1. In this embodiment, the plunger pressure accumulator 1 comprises an elongated shell 2 with an interior space defined by its walls. The space is provided with a plunger having its body denoted with reference numeral 3. In this embodiment, the plunger 3 is an elongated hollow sleeve type element with a closed first end. Thus, in this case, the plunger is annular in its cross-section, but the shape is not necessarily limited to that. The cross-section can also be for example a square or rectangle. Likewise, the shell 2 can have a correspondingly deviant cross-sectional shape.

Between the plunger 3 and the shell 2 is provided a slide element 2*b* of the invention, upon which the plunger 3 is supported to move in a space. Therefore, the structure of a plunger pressure accumulator 1 shown in FIG. 1 indeed comprises a plunger as far as its piston is concerned. The slide element may consist of one or more annular slide bearing elements 2*b* disposed successively in a longitudinal direction of the shell. In this case, the slide element 2*b* is made stationary relative to the shell 2, but it can also be made stationary relative to the plunger 3. FIG. 1 presents two slide bearing elements.

Between the plunger 3 and the shell 2 is further provided a sealing element 2*c* or some other element, which establishes a sealing effect and, together with the plunger 3, divides the space in a lengthwise direction of the shell 2 into two subspaces 4 and 5. In this case, the sealing element 2*c* is made stationary relative to the shell 2, thereby leaving the sealing surface in engagement with an external surface 3' of the plunger 3.

Of these, the first subspace 4 is suppliable with a hydraulic fluid by way of a port 2*a* provided in connection with the shell 2. The source of hydraulic fluid is typically some external system, including a hydraulic circuit that the plunger pressure accumulator 3 is in communication with. The second subspace 5 is provided with a pressurized gas. Further in this embodiment, the space inside the walls of the hollow plunger 3 establishes a third subspace 6 which is in communication with the second subspace 5. Hence, the third subspace 6 also contains pressurized gas at a pressure equal to that of the second subspace 5. The pressurized gas consists of a compressible gas. This compression takes place as the first subspace 4 is supplied with an incompressible or substantially incompressible hydraulic fluid from an external system. As a result of this, the plunger 3 or some other corresponding element moves (to the right in FIG. 1), thereby reducing a combined volume of the second subspace 5 and the third subspace 6. Another result of this is the warming of pressurized gas in the second and third subspaces 5 and 6.

In a preferred embodiment of the invention, the plunger 3 comprises a first insulating layer, which is denoted with reference numeral 10*a*. The first insulating layer 10*a* is preferably disposed in engagement with an inner surface of the walls of the plunger 3 so as to cover the entire internal surface of the plunger 3.

The plunger pressure accumulator 3 according to the invention is provided with at least one regenerator, which is stationary relative to the shell 2 or the plunger 3. FIG. 1 shows two regenerators 7*a* and 7*b*, which can be alternatives to each other or which can be applied concurrently in the plunger pressure accumulator 3 of the invention. It should be noted that these are merely examples of regenerator configurations, nor is the invention limited to these configurations and positions. Thus, the regenerator 7*a* presents one solution for a type of regenerator which is stationary relative to the shell 2. The elongated regenerator 7*a* is attached to an end face of the shell 2 and adapted to extend a distance into the third subspace 6. Hence, the first insulating layer 10*a* provided on the plunger 3 surrounds the regenerator 7*a* at least partially. As the plunger 3 is moving to the right in FIG. 1, the regenerator will be respectively surrounded by the first insulating layer 10*a* over a longer distance. The regenerator 7*a* and/or the plunger 3 can also be designed in terms of its length so as to be surrounded by the insulating layer 10*a* only in a compression phase, i.e. as the piston 3 is being displaced by hydraulic pressure (to the right in FIG. 1). The structure and/or material of the regenerator 7*a* is such that the pressurized gas present in the third subspace 6 is able to flow into the regenerator 7*a* and, if necessary, through the regenerator 7*a* into the second subspace 5.

As an alternative or in addition to the regenerator 7*a*, the plunger pressure accumulator 1 may include a regenerator 7*b* which is stationary relative to the plunger 3. FIG. 1 shows a regenerator 7*b*, which has a cavity type structure and which is disposed in engagement with the insulating layer 10*a* so as to have the first insulating layer 10*a* completely covered by the regenerator 7*b*. Thus, when the plunger pressure accumulator 1 is in a compressed condition, the regenerator 7*a* (if present), which is stationary relative the shell 2, has moved into a cavity of the regenerator 7*b* which is stationary relative to the plunger 3. In this embodiment, it is the cavity of the regenerator 7*b* which establishes the third subspace 6. The insulator layer 10*a* of the plunger 3 can be alternatively omitted and optionally replaced for example with a thicker layer of regenerator material, whereby the regenerator 7*b* will have a greater mass and heat capacity.

In a preferred embodiment of the invention, the internal surface of the shell 2 defined by the second subspace 5 is provided with a second insulating layer 10*b*. This can be implemented in such a way that the second insulating layer 10*b* is attached to the shell 2 in a manner making it stationary relative to the shell 2. This is made possible in a particularly advantageous way by having the plunger 3 supported to move with the assistance of the slide elements 2*b* to a distance apart from an internal surface 4*a* of the first subspace 4 and from an internal surface 5*a* of the second subspace 5. Accordingly, as opposed to prior known solutions, for the second insulating layer there is left, between the plunger 3 and the internal surface 4*a*, a space (which therefore in this case is a part of the second subspace 5) in which the second insulating layer 10*b* can be easily accommodated inside the shell 2

What can be further seen in FIG. 1 is one further embodiment for a second regenerator, which is stationary relative to the shell 2. The second regenerator is denoted with reference numeral 8, and it is in this case constructed as a layer of desired thickness around the insulating layer 10*b*. It should be noted that, from the operational standpoint of the plunger pressure accumulator 1 of the invention, the second insulating layer 10*b* is not an absolute necessity, which is why the second regenerator 8 can be optionally disposed in a direct engagement with the internal surface 5*a* of the second subspace 5 of the shell 2. This is made possible by having the plunger 3 supported to move, according to the invention, with the assistance of the slide elements 2*b* to a distance apart from the internal surface 4*a* of the first subspace 4 and from the internal surface 5*a* of the second subspace 5.

The plunger type structure of a plunger pressure accumulator according to the invention enables the use of diverse materials in regenerators. The employed material can be for example a metal, ceramic, composite and/or polymer. It is also possible to use a material, such as paraffin, based on phase transition. In addition, the structure of regenerators can be preferably sintered, mesh-like, fibrous, granular and/or foamy. The implementation of structurally other types of regenerators is possible. The purpose of such structures is to provide an interior space of the shell 2, especially the second subspace 5, at desired locations, with a regenerator sufficient in terms of its thermal capacity, but also in terms of its heat transfer capacity. Particularly the regenerator, which is in communication with a gas of the second subspace 5, as well as with a gas of the third subspace 6, must have an area which is large in comparison with that of the second subspace's internal surface 5*a*. An objective is to collect from the gas as thoroughly as possible the heat generated during the compression phase and to deliver it back into the gas during a discharge phase or expansion phase. At the same time, there is provided an effective blockage of heat flows towards the shell by binding the heat as well as by using its appropriate structure and materials for impeding and stop ping the flow of heat into the shell structure. This objective is attained particularly well with a plunger pressure accumulator construction of the invention, since the plunger 3 does not hinder the positioning of regenerators particularly in the second subspace 5. Depending on the material and structure of a regenerator or regenerators, there will be achieved for the regenerator a surface area which is approximately 10 to 1000-fold compared to the internal surface 5*a* while the thermal capacity of the regenerator or regenerators is nevertheless sufficient for the recovery of heat generated in the gas. However, the regenerator's surface area with respect to the internal surface 5*a* can be other than this.

Further in a plunger pressure accumulator 1 of the invention, the regenerator 7*a*, 7*b*, 8, in terms of its structure and with material selections, can be constructed as a heat transfer device or something like a heat transfer device. Hence, the regenerator 7*a*; 7*b*; 8 also works as an element which delivers the heat stored therein as desired. Thus, the regenerator or heat transfer device allows the thermal energy, stored in the regenerator 7*a*; 7*b*; 8 in the compression phase of pressurized gas, to be released at the latest when the plunger pressure accumulator 1 terminates its discharge phase. In a typical case, the duration of a discharge phase is 1-60 seconds but, depending on the application and the plunger pressure accumulator's capacity, it may deviate from the aforesaid time frame, being for example 0.5-600 seconds. Naturally, the regenerator or heat transfer device can be constructed so as to deliver thermal energy even after the discharge phase has terminated.

In FIG. 1 is shown an elongated plunger, whose length parallel to the direction of motion is about 2.7-fold with respect to its width transverse to the lengthwise dimension, in this case with respect to the outer diameter of a plunger with circular cross-section. In FIG. 3 is shown a plunger pressure accumulator structurally similar to that of FIG. 1, but the length to transverse width ratio of its plunger 3 is less, being about 1.4. It can be seen from FIG. 3 that, when the shell 2 is dimensioned in keeping with the width of a plunger, the second subspace 5, and the optional third subspace 6 shown in FIG. 3, increase in volume considerably with respect to the internal surface 5*a* (which is the heat transfer area) of the subspace 5. As a result, the shell 2 has even more favorable facilities in its interior space of providing the plunger pressure accumulator 1 with a necessary number of regenerators 7*a*, 7*b*, 8. In other words, the mass of regenerators will be sufficient for achieving a desired recovery of heat. For example, the third subspace 6 internal of the hollow plunger 3 can be set up with several layers of regenerators 7*b*. It is preferred that, in terms of its length parallel to the direction of motion, the plunger 3 be 0.01 to 1000-fold in proportion to its transverse width. Consequently, the plunger 3 of the invention, equipped with the regenerator 7*b*, can have a width which even exceeds its length parallel to the direction of motion. Generally speaking, such a plunger or floating piston solution provides a cost effective way of constructing truly heavy-duty and structurally durable plunger pressure accumulators because, with the exception of an outer surface of the plunger 3, its structure does not require perfectly finished surfaces, nor are there moving parts between the shell 2 and the plunger 3.

In FIG. 2 is shown another preferred embodiment of the invention, wherein the slide element, which is denoted with reference numeral 2*b*', is structurally different from the annular slide bearing elements 2*b* presented in FIGS. 1 and 3. FIG. 2 shows primarily the features essential for understanding this particular embodiment. It can be seen from FIG. 2 that the slide element 2*b*' is preferably a thin-walled tube. The thin-walled tube 2*b*' extends preferably co-directionally with the motion of a plunger 30 substantially across or all the way across the interior space of the shell 2. In this case, the internal surface of the tube 2*b*' constitutes a sliding surface upon which the plunger 30 is resting while moving in the interior space of the shell 2. The plunger 30 is depicted here as a piston included in a traditional piston accumulator, but it can also be structurally similar to the plunger 3 shown in FIG. 1. To ensure operation as favorable as possible, the slide element 2*b*' is made of material as small as possible in terms of its specific heat capacity and wall thickness. Depending on the material, it is in any case preferred for the wall thickness not to exceed 0.5 millimeters. A lower limit for the wall thickness is only defined by the characteristics of existing materials as well as those to be developed in the future. The sleeve 2*b*' is preferably dimensioned in such a way that its outer surface remains a distance apart from the internal surface 4*a* of the first subspace 4 and from the internal surface 5*a* of the second subspace 5. This enables a regenerator 8 to be disposed between the outer surface of the sleeve 2*b*' and at least the internal surface 4*a* and optionally the internal surface 5*a*. The sleeve 2*b*' is dimensioned in the second subspace 5 so as to leave a gap 2*b*" between en end face of the shell 2 and an edge of the sleeve. Therefore, in the second subspace 5, and between the sleeve 2*b*' and the internal surfaces 5*a* and 5*a* of the second subspace 5 and the first subspace 4, exists an equal pressure. It is possible to provide the slide element 2*b*' with separate support elements (not shown) for supporting it on the internal surfaces 5*a* and 4*a*. What should also be noted is an embodiment, which has not been shown but in which the sleeve 2*b*' can have its outer surface dimensioned in such a way that the sleeve's outer surface is in contact with the internal surfaces 4*a* and 5*a*. Hence, the distance from sliding surfaces of the piston 30 to the internal surfaces 4*a* and 5*a* is at least equal to the wall thickness of the slide element 2*b*'.

In the embodiment shown in FIG. 2, it is possible that at least the second subspace 5, and optionally the first subspace 4, be provided with a regenerator 8 which can be fitted between the outer surface of the sleeve 2*b*' and the internal surface 5*a* (and optionally the internal surface 4*a* of the first subspace 4). Hence, the regenerator 8 participates in supporting the slide element 2*b*' in place in a direction transverse to the motion direction of the piston 30. Further in this case, a regenerator 7*b*, which is thus only presented by way of example, can be arranged to be stationary relative to the piston 30. In addition to this, to the arrangement of FIG. 2 can be applied solutions, which are shown in FIGS. 1 and 3 and involve regenerators 7*a* and 7*b* as well as insulating layers 10*a* and 10*b*, and which need not be described in this context.

Moreover, the plunger pressure accumulator 1 according to the invention can be provided with other equipment for improving a plunger pressure accumulator of the invention in terms of its functionality, as well as for improving the overall efficiency of a hydraulic external system or other external system communicating with the plunger pressure accumulator. As an example, FIG. 4 shows a heat exchanger denoted with reference numeral 11. The heat exchanger 11 is disposed in the second subspace 5 within a zone between an outer surface of the plunger 3 and an internal surface of the second subspace 5, for example inside a mesh-like regenerator 8 (a heat transfer device). This is made possible by a plunger pressure accumulator of the invention, wherein the motion of the plunger 3 allows the positioning of regenerators and other stationary additional features. The heat exchanger 11 has a function of bringing thermal energy from an external system into the second subspace 5 so as to replace, whenever necessary, the thermal energy displaced from gas and regenerators or heat transfer devices into the environment (this occurring to a certain extent especially in long compression phases and in the static compression phase of a plunger pressure accumulator). The thermal energy is brought to the heat exchanger for example from the cooling fluid or exhaust gases of internal combustion engines, from power plants based on renewable energy, such as solar energy, and/or from industrial processes in general. Operation of the heat exchanger 11 can be made automatic (active) for example by means of control elements 22*a* between the heat exchanger 11 and an external system 22, which are used for controlling the supply of thermal energy contained for example in a fluid substance (gas, liquid) to the heat exchanger 11 and thereby into the second subspace 5. The supply of thermal energy can be controlled, for example with the control elements 22*a*, on the basis of parameters obtained for example from the second subspace 5, such as gas temperature, pressure and/or a working phase of the plunger pressure accumulator 1. Whenever necessary, the heat exchanger 11 enables a removal of heat from the second subspace 5.

FIG. 4 shows also cooling means 12*a* and 12*b*. The cooling means 12*a* consist of cooling ribs or the like disposed on an outer surface of the shell 2 at the first subspace 4. Alternatively, or in addition to the ribs 12*a*, in engagement with the first subspace 4, for example on its internal surface 4*a*, can be disposed conduits 12*b* for liquid cooling. The purpose of these is to prevent the temperature of a hydraulic fluid present in the first subspace 5 from increasing too much. In other words, the purpose thereof is to cool the hydraulic fluid as may be needed. The thermal energy that has transferred from hydraulic fluid to the cooling means 12*a* and/or 12*b* can be recovered and exploited for example in the heat exchanger 11. On the other hand, it is also possible to provide means from the heat exchanger 11 to the cooling means 12*a* and/or 12*b*, which can be used, as necessary, for cooling the hydraulic fluid present in the subspace 5. These actions can be controlled for example by means of the control elements 22*a* the same way as in relation to the heat exchanger 11. It is also conceivable that, in extreme conditions, such as at sub-zero temperatures, it is possible to introduce, particularly by way of the cooling means 12*b*, a medium capable of warming up the hydraulic fluid.

The present invention is not limited merely to the foregoing embodiments but can be applied within the scope of protection defined by the appended claims.

The invention claimed is:

1. A plunger pressure accumulator, comprising:

a shell;

a plunger which is adapted to move relative to the shell into an interior space of the shell, the space being divided into at least two subspaces, the first subspace of which is suppliable with hydraulic fluid of an external system and the second subspace is provided with a pressurized gas, wherein between the plunger and the shell is arranged a slide element upon which the plunger is supported to move to a distance apart from an internal surface of the first subspace and from an internal surface of the second subspace, and that the plunger pressure accumulator is provided with at least one regenerator which is stationary relative to the shell or the plunger.

2. The plunger pressure accumulator according to claim 1, wherein an outer surface of the plunger is surrounded across a first end area by the first subspace and across a second end area by the second subspace.

3. The plunger pressure accumulator according to claim 1, wherein the slide element comprises one or more annular slide bearing elements, which is or are adapted to be stationary relative to the shell.

4. The plunger pressure accumulator according to claim 1, wherein the slide element comprises one or more annular slide bearing elements, which is or are adapted to be stationary relative to the plunger.

5. The plunger pressure accumulator according to claim 1, wherein the slide element is a thin-walled tubular element, which extends co-directionally with the motion of the plunger substantially across or all the way across the interior space of the shell.

6. The plunger pressure accumulator according to claim 1, wherein the plunger comprises:

a third subspace which is in communication with the second subspace.

7. The plunger pressure accumulator according to claim 1, wherein the plunger comprises an insulating layer, which surround partially or completely the at least one regenerator at least in the compression phase of pressurized gas.

8. The plunger pressure accumulator according to claim 1, wherein at least the shell has the internal surface of its second subspace surrounded by a second regenerator.

9. The plunger pressure accumulator according to claim 8, wherein the structure and/or material of the second regenerator is selected to enable the regenerator to operate as a stabilizing element for reducing the flow of gas in the second subspace.

10. The plunger pressure accumulator according to claim 1, wherein the second subspace has its internal surface provided with a second insulating layer.

11. The plunger pressure accumulator according to claim 10, wherein the shell has its outer surface provided with a third insulating layer.

12. The plunger pressure accumulator according to claim 11, wherein, in connection with the shell, is provided a heat exchanger for supplying the pressurized gas with extra head produced by an external system.

13. The plunger pressure accumulator according to claim 12, wherein the heat exchanger is located inside a space defined by the second insulator layer and/or the third insulating layer.

14. The plunger pressure accumulator according to claim 1, wherein, in connection with the second subspace, an outer surface of the shell is configured to cool a hydraulic fluid present in the plunger pressure accumulator.

15. The plunger pressure accumulator according to claim 1, wherein the at least one regenerator arranged in the plunger pressure accumulator is stationary relative to the plunger and which is completely surrounded by the first insulating layer.

16. The plunger pressure accumulator according to claim 1, wherein the plunger is an elongated hollow element, which is closed at its first end face and whose hollow second end face opens into the second subspace.

17. The plunger pressure accumulator according to claim 1, wherein, in terms of its length parallel to motion, the plunger is 0.01 to 1000-fold as compared to its transverse width.

18. The plunger pressure accumulator according to claim 1, wherein the regenerator, which is stationary relative to the plunger, extends in a longitudinal direction of the shell a distance into the second subspace.

19. The plunger pressure accumulator according to claim 1, wherein a material of the regenerator is a metal, ceramic, composite, polymer, and/or paraffin and the structure of the generator is sintered, mesh-like, fibrous, granular, and/or foamy to provide a sufficient heat transfer capacity of the regenerator, whereby the regenerator has a structure which allows the thermal energy stored in the regenerator in the compression phase of pressurized gas to be released at the latest when a discharge phase of the plunger pressure accumulator terminates.

20. The plunger pressure accumulator according to claim 19, wherein the discharge phase has a duration of 1-60 seconds.

21. The plunger pressure accumulator according to claim 1, wherein the material of the regenerator is a metal, ceramic and/or polymer.

22. The plunger pressure accumulator according to claim 1, wherein the material of the regenerator is paraffin and/or some other phase transition material.

23. The plunger pressure accumulator according to claim 1, wherein the regenerator has a sintered, mesh-like, fibrous, granular and/or foamy structure.

24. The plunger pressure accumulator according to claim 1, wherein between the plunger and the shell is provided a sealing element or some other element producing a sealing effect, which, together with the plunger, divides the space in a longitudinal direction of the shell into the first subspace and the second subspace.

* * * * *